US006042246A

United States Patent [19]

Waldmann

[11] Patent Number: 6,042,246

[45] Date of Patent: Mar. 28, 2000

[54] WIDE-BEAM INDIRECT LAMP ASSEMBLY

[75] Inventor: Gerhard Waldmann, Dauchingen, Germany

[73] Assignee: Herbert Waldmann GmbH & Co., Germany

[21] Appl. No.: 09/313,614

[22] Filed: May 18, 1999

[30] Foreign Application Priority Data

May 18, 1998 [DE] Germany ..... 198 22 305

[51] Int. Cl.[7] ..... F21S 3/00

[52] U.S. Cl. ..... 362/217; 362/147

[58] Field of Search ..... 362/217, 223, 362/225, 355, 496, 297, 255, 346

[56] References Cited

U.S. PATENT DOCUMENTS 3,803,401 4/1974 Drews ..... 362/218
5,823,656 10/1998 Waldmann ..... 362/147

FOREIGN PATENT DOCUMENTS 0 538 727 A1 10/1992 European Pat. Off. .
195 37 685 C1 5/1998 Germany .

*Primary Examiner*—Sandra O'Shea
*Assistant Examiner*—Hargobind Sawhney
*Attorney, Agent, or Firm*—Eugene E. Renz, Jr. PC

[57] ABSTRACT

A wide-beam, indirect lamp assembly comprising an elongated lamp housing symmetrical about a vertical center plane (26) and transparent to the light directed downward and open at the top and including at least two fluorescent tubes disposed on each side of, and equal distances away from the center plane. At least one reflector is provided for each tube in the lamp housing near each tube, said reflector operable to deflect at least part of the light beaming upward from the tube. Each reflector (30) is made of a perforated sheet metal and comprises, in vertical cross section, a first, generally vertical section (32) on the side of the associated fluorescent tube (28) facing the center plane (26), a second, generally horizontal section (34) on the top surface of the associated fluorescent tube (28); and a third section (36), adjoining the second section (34). The third section (36) slants upward and away from the center plane (26).

11 Claims, 3 Drawing Sheets

WIDE-BEAM INDIRECT LAMP ASSEMBLY

FIELD OF THE INVENTION

The present invention relates to improvements in wide-beam indirect lamp assemblies.

BACKGROUND OF THE INVENTION

Indirect lamps of this type, the design of which solves the problem of excessive brightness on the ceiling directly above the lamp in spite of a short distance between the ceiling of the room and the lower edge of the lamp while at the same time allowing most of the light to be directed laterally and obliquely upward to achieve good, uniform illumination of the room, are known from DE-C1 195-37, 685.

Whereas this indirect lamp effectively solves the problem described above for fluorescent tubes with a diameter of 26 mm and a corresponding brightness, the problem becomes so much worse when fluorescent tubes with a diameter of 16 mm are used that the known lamp is no longer adequate in all cases.

SUMMARY OF THE INVENTION

With the foregoing in mind, the goal of the invention is therefore to improve a lamp of the type described above in such a way that good, uniform illumination of the room is achieved even in the case of fluorescent tubes of smaller diameter while excessive brightness on the ceiling directly above the lamp is avoided. To this end, the wide beam indirect lamp assembly of the present invention comprises an elongated lamp housing in a wide-beam, indirect lamp assembly comprising an elongated lamp housing symmetrical about a vertical center plane and transparent to the light directed downward and open at the top, at least two fluorescent tubes disposed on each side of, and equal distances away from the center plane, at least one reflector for each tube in the lamp housing near each tube, said reflector operable to deflect at least part of the light beaming upward from the tube, characterized in that each reflector being made of a perforated sheet metal and comprising, in vertical cross section, a first, generally vertical section on the side of the associated fluorescent tube facing the center plane, a second, generally horizontal section on the top surface of the associated fluorescent tube, and a third section, adjoining the second section, said third section slanting upward and away from the center plane.

Through the use of reflectors of perforated sheet metal next to and above the fluorescent tubes, the ceiling above the lamp receives sufficient light, but at the same time excessive brightness in this area of the ceiling near the lamp is avoided. Simultaneously, most of the light from the tubes is deflected laterally upward over a wide angle without being blinding in a lateral and slightly downward direction.

Advantageous embodiments of the invention are put under protection in the subclaims. If desired, perforated sheet-metal parts can be provided in the housing together with additional reflectors in the middle, side, and lower area of the interior space of the lamp housing to ensure an even more uniform distribution of the light, to avoid shadows, and especially to obtain uniform illumination of the housing in the downward direction.

BRIEF DESCRIPTION OF THE DRAWINGS

These and other objects of the present invention and various features and details of the operation and construction thereof are hereinafter more fully set forth with reference to the accompanying drawings, wherein.

DESCRIPTION OF THE METHOD AND SYSTEM

Figure 1:
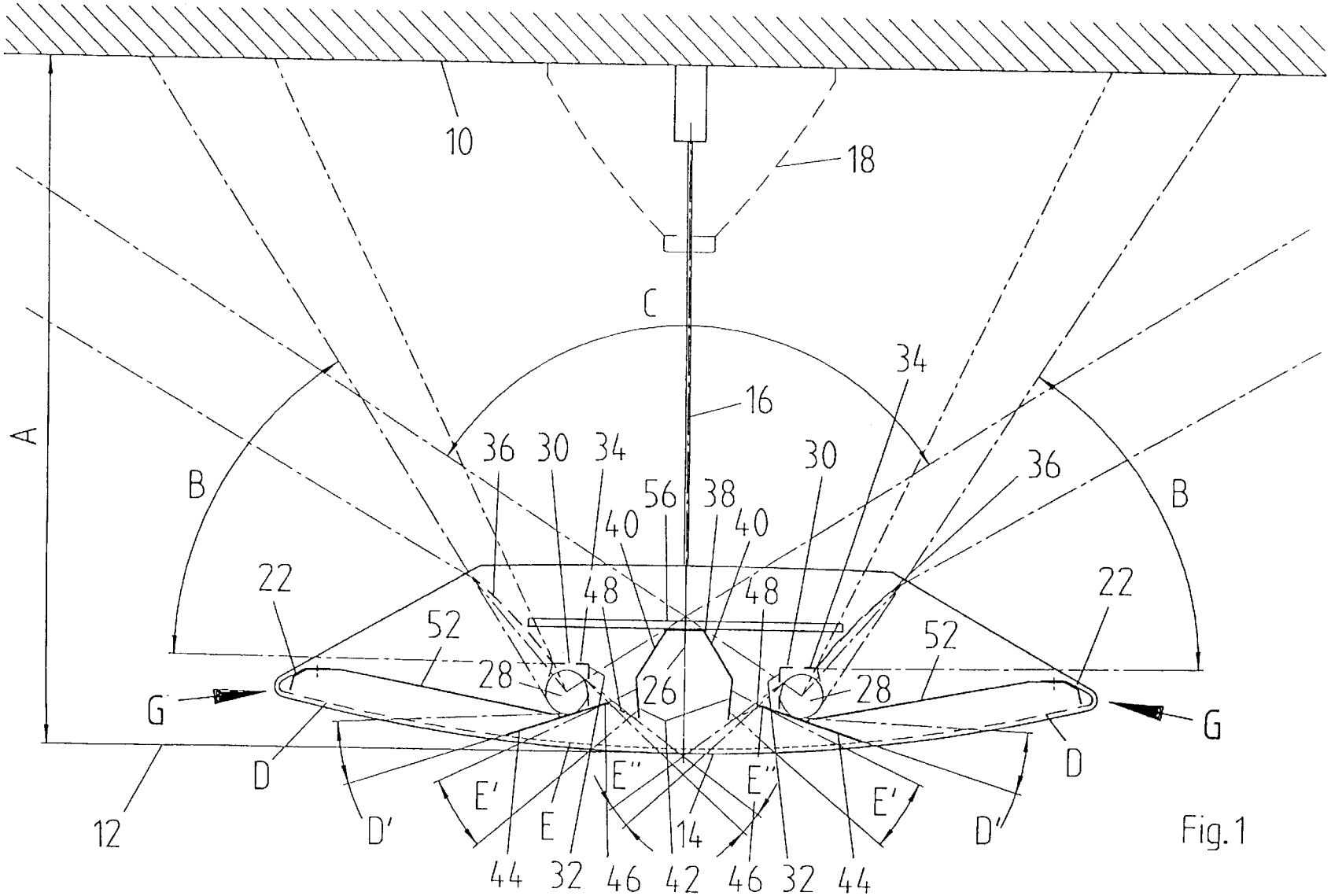
FIG. 1 shows a schematic diagram of a cross section perpendicular to the longitudinal axis of the indirect lamp according to the invention, which is hung just below the ceiling of a room.
Figure 2:
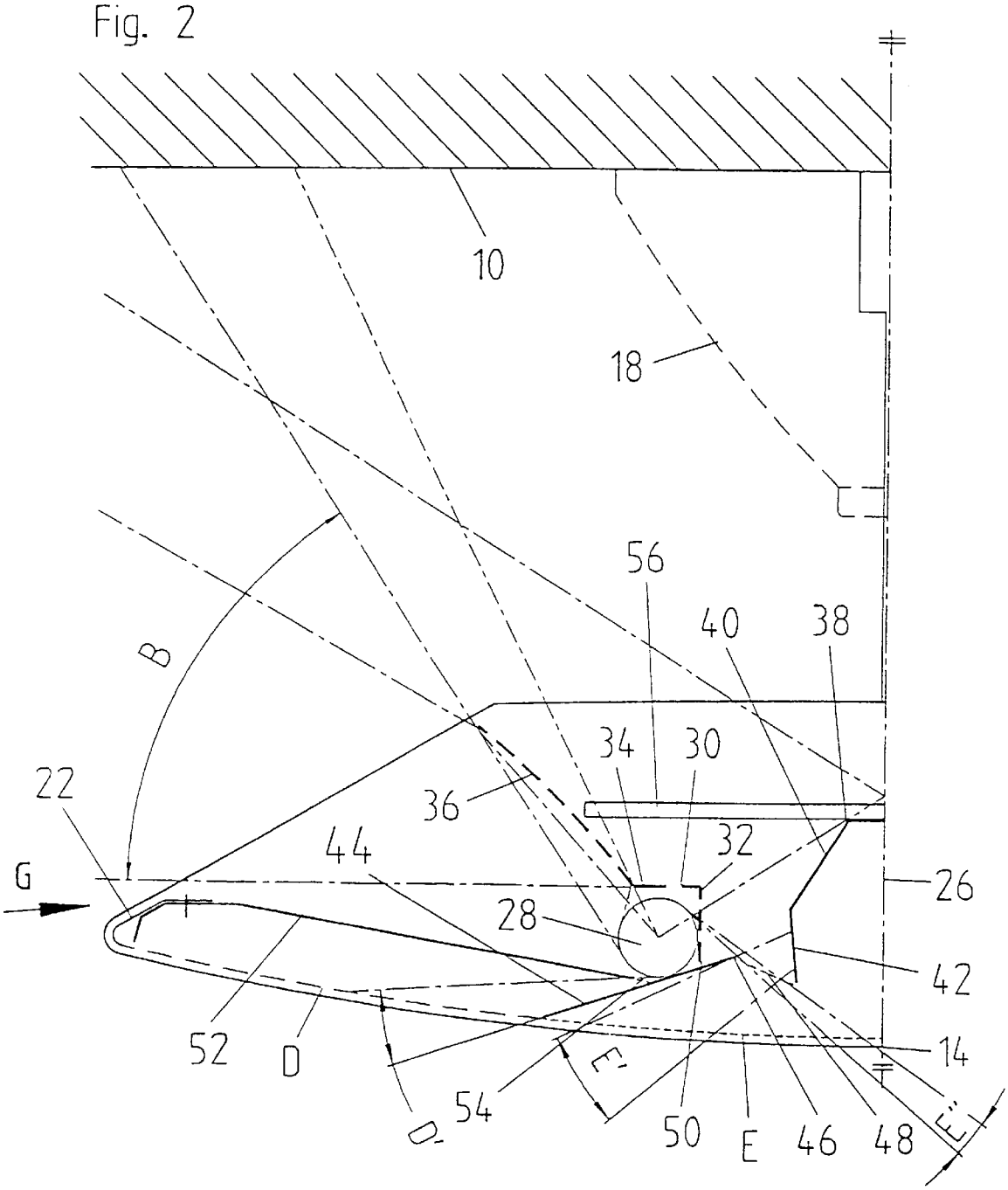
FIG. 2 shows an enlarged view of the left half of FIG. 1.

Referring now to the drawings and particularly to FIG. 1, Because distance A from the ceiling 10 to the lower edge 12 of lamp housing 14 according to FIG. 1 should be as short as possible, a relatively flat lamp housing 14 is attached by means of a short lamp shaft 16 and an approximately conical ceiling anchoring collar 18 a short distance away from ceiling 10. Lamp housing 14 has a convex curvature at the bottom and consists of transparent material, although it can be in the form of, for example, perforated sheet metal, woven mesh, braided mesh, milk glass, or some other type of perforated material, to allow more or less of the light to pass through in the downward direction. Along the side edges of lamp housing 14, the housing has upward-bent sections 22. Lamp housing 14 is open at the top.

Lamp housing 14 is symmetrical to a vertical center plane 26, which extends along the longitudinal axis of lamp housing 14. At equal distances from center plane 26, two fluorescent tubes 28, one on each side of center plane 26 and parallel to it, are installed at the same height above housing 14, that is, approximately at the level of upward-bent sections 22 of lamp housing 14.

Near each fluorescent tube 28 there is a mirror-finish reflector of per perforated sheet metal, which is designated in general by the number 30. A first, approximately vertical section 32 rests against the side of the associated fluorescent tube 28 facing center plane 26 and projects slightly beyond it in the upward direction. A short distance from the top side of fluorescent tube 28, a second, approximately horizontal section 34 of reflector 30 extends from first section 32. The length of this second section is approximately the same as the diameter of fluorescent tube 28. Second section 34 is joined to a third, longer section 36, which slants upward and away from center plane 26. The top surface of this section is slightly convex, whereas the bottom surface is slightly concave. In the embodiment shown, it has an average slope of about 45°. In the vertical section of FIG. 1, the length of third section 36 is several times greater than that of first section 32 or of section 34.

In the area between the two reflectors 30 and the two fluorescent tubes 28, there is a center reflector 38, symmetrical to center plane 26. This reflector has a flat upper reflector surface 40 on each side of center plane 26, this upper part slants upward toward center plane 26. The reflector also has an essentially flat lower reflector surface 42 on each side; this part slants downward toward the center plane. Center reflector 38 also has a lower reflector 44 under each of fluorescent tubes 28; this part slants downward and away from central plane 26. This lower reflector is either made as a single piece with the center reflector or is connected rigidly to it in some other way. Between flat lower reflector surface 42 and upper edge 46 of lower reflector 44, there is an opening 48, which parallels center plane 26 and extends down the entire length of the lamp; this opening can, however, be interrupted by thin retaining webs or the like (not shown). The entire center reflector 38, including lower reflector 44, consists preferably of closed, mirror-finish material. Lower edge 50 of first vertical section 32 of each reflector 30 preferably rests on the top surface of the associated lower reflector 44.

A side reflector 52 is provided above each of the two lateral sections D of lamp housing 14 in the area removed from center plane 26; these reflectors are a certain distance away from the sections in question and approximately parallel to them. Their outer edge starts approximately at bent section 22 of housing 14, and their inner edge 54 is a short distance below the associated fluorescent tube 28 but above the associated lower reflector 44. They are essentially flat except for the outer edge areas. They consist preferably also of closed, mirror-finish material and slant slightly downward toward the center plane. As a result, an upward-opening beam angle B for the light of the associated fluorescent tube 28, unhindered by reflectors, is created between side reflector 52 and third section 36 of the associated reflector 30. The beam angle area B slants laterally upward, as a result of which it is impossible to be blinded by looking at the lamp at a slant from below in the direction of arrow G, but at the same time the room receives good, uniform illumination laterally and in the upward direction. The third, curved section 36 of perforated sheet-metal reflector 30 determines the size of beam angle B. The beams from fluorescent tube 28 are prevented from proceeding directly downward toward housing 14 by side reflector 52 and lower reflector 44. Simultaneously, side reflectors 52 support the wide-beam characteristic of the lamp, which is determined essentially by angle B. A transparent, horizontal cover plate 56, which offers center reflector 38 and fluorescent tubes 28 a certain protection against dirt, is mounted above center reflector 38 and fluorescent tubes 28.

The form of the three sections of the two perforated sheet-metal reflectors 30 described above serves to block off most but not all of the light from fluorescent tubes 28 going in the direction of ceiling 10 above reflectors 30. Because these reflectors 30 are made of perforated metal, a certain beam area, determined by angle C, is obtained directly upward against ceiling 10.

So that lamp housing 14 itself is illuminated as uniformly as possible, light is beamed directly over an angle D' from each of the two fluorescent tubes 28 through the gap between inner edge 54 of side reflector 52 and the top surface of lower reflector 44. Lateral sections D of housing 14 are thus lighted. Some of the light passing through first section 32 of perforated sheet metal reflector 30 and through opening 48 is reflected from lower reflective surface 42 of center reflector 38; this beam continues downward over an angle E' onto central section E of housing 14. Another component of the light from fluorescent tubes 28 passing directly through opening 48 strikes center section E over an angle E'. In some areas, the incident angle is so flat that no direct light would be able to pass outward through, for example, the holes in the perforated sheet-metal material of housing 14. As a result, housing 14 receives nearly uniform lighting. To optimize this, it would be possible and advantageous to lay a transparent film on the inside surface of housing 14.

Figure 3:
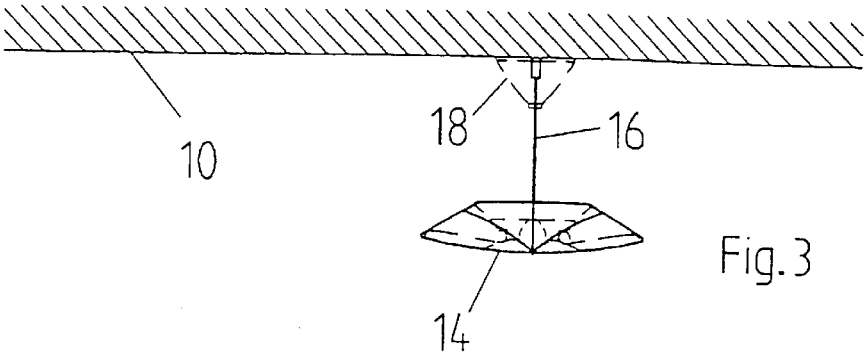
FIG. 3 shows a reduced view of the lamp according to FIG. 1.
Figure 4:
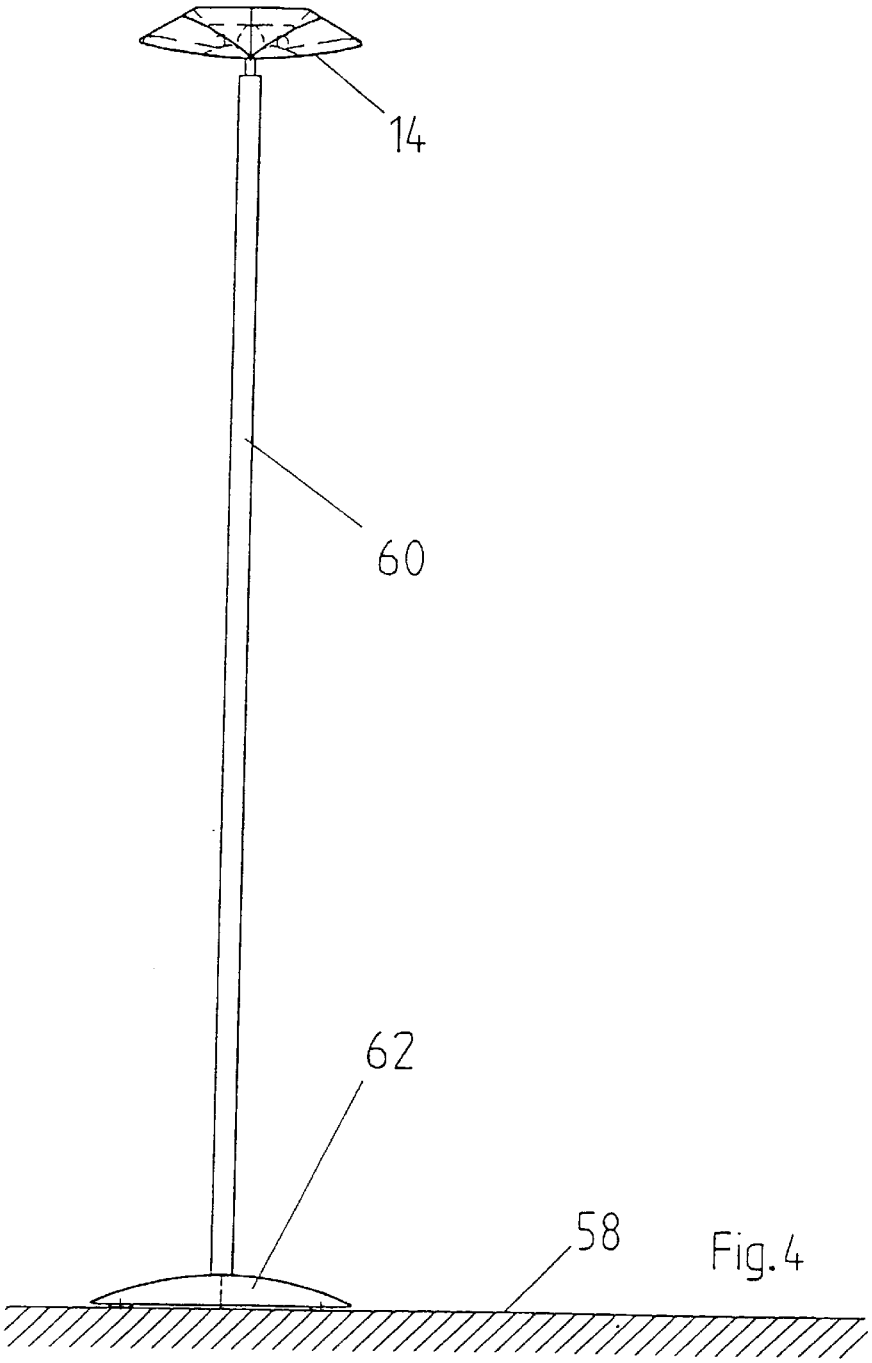
FIG. 4 shows the lamp according to FIG. 1 mounted near the ceiling on a tall stand, without the parts needed to suspend it.

FIG. 3 shows the lamp according to FIG. 1 suspended just below ceiling 10 in approximate relation to the height of the room, whereas FIG. 4 shows the lamp mounted on a tall stand 60 with base 62, standing on floor 58.

Even though particular embodiments of the present invention have been illustrated and described herein, it is not intended to limit the invention and changes and modifications may be made therein within the scope of the following claims for example.

What is claimed is:

1. In a wide-beam, indirect lamp assembly comprising an elongated lamp housing symmetrical about a vertical center plane (26) and transparent to the light directed downward and open at the top, at least two fluorescent tubes disposed on each side of, and equal distances away from the center plane, at least one reflector for each tube in the lamp housing near each tube, said reflector operable to deflect at least part of the light beaming upward from the tube, each reflector (30) being made of a perforated sheet metal and comprising, in vertical cross section, a first, generally vertical section (32) on the side of the associated fluorescent tube (28) facing the center plane (26), a second, generally horizontal section (34) on the top surface of the associated fluorescent tube (28); and a third section (36), adjoining the second section (34), said third section (36) slanting upward and away from the center plane (26).

2. In an indirect lamp assembly as claimed in claim 1, wherein the third section (36) has a slight concave curvature toward the center plane (26).

3. In an indirect lamp assembly as claimed in claim 1, including a center reflector symmetrical to the center plane is located in the area between the two reflectors and the two fluorescent tubes, said center reflector having two upper reflector surfaces which slant upward toward the center plane and two lower reflector surfaces which slant downward toward the center plane said center reflector (38) having lower reflectors (44), which slant downward and away from the center plane (26) and pass underneath the fluorescent tubes (28), and at least one opening (48) being provided between the approximately flat lower reflector surface (42) and the upper edge (46) of the lower reflector (44).

4. In an indirect lamp assembly as claimed in claim 3, wherein the upper and lower reflector of said center reflector are flat.

5. In an indirect lamp assembly as claimed in claim 3, wherein the upper and lower reflector of said center reflector are curved.

6. In an indirect lamp assembly as claimed in claim 3, wherein a transparent, horizontal cover plate (56) is provided in the lamp housing above the center reflector (38) and the fluorescent tubes (28).

7. In an indirect lamp assembly as claimed in claim 1, wherein the lamp housing (14) consists at least in part of partially transparent material such as perforated sheet metal, woven mesh, braided mesh, milk glass, or perforated material.

8. In an indirect lamp assembly as claimed in claim 1, wherein the lower edge (50) of the first, approximately vertical section (32) of each reflector (30) preferably rests on the top surface of the associated lower reflector (44).

9. In an indirect lamp assembly as claimed in claim 1, wherein a side reflector (52) is provided above each of the lateral sections (D) of the lamp housing (14) in the area removed from the center plane (26), a certain distance away from, and parallel to, the lateral section.

10. In an indirect lamp assembly as claimed in claim 9, wherein each side reflector (52) slants slightly downward toward the center plane (26) in such a way that, between the side reflector (52) and the third section (36) of the associated reflector (30), an upward-opening beam angle (B) for the light of the associated fluorescent tube (28), unhindered by reflectors, is formed.

11. In an indirect lamp assembly as claimed in claim 9, wherein the edge (54) of each side reflector (52) pointing toward the center plane (26) is below the associated fluorescent tube (28) and a short distance away from the top surface of the associated lower reflector (44).

* * * * *